United States Patent [19]

O'Neill

[11] 3,934,581

[45] Jan. 27, 1976

[54] BREATHING APPARATUS

[75] Inventor: Wilbur J. O'Neill, Severna Park, Md.

[73] Assignee: Westinghouse Electric Corporation, Pittsburgh, Pa.

[22] Filed: Sept. 3, 1971

[21] Appl. No.: 177,859

Related U.S. Application Data

[63] Continuation of Ser. No. 832,669, June 12, 1969, abandoned.

[52] U.S. Cl. ..... 128/142; 128/202

[51] Int. Cl.[2] ..... A61M 16/00

[58] Field of Search ..... 128/142, 142.2, 147, 202, 128/142.3, 142.4, 142.5, 142.6, 142.7; 224/8, 25

[56] References Cited

UNITED STATES PATENTS 3,385,293 5/1968 Phillips ..... 128/202

FOREIGN PATENTS OR APPLICATIONS 721,349 6/1942 Germany ..... 224/8

878,119 9/1961 United Kingdom ..... 128/142

*Primary Examiner*—Robert W. Michell
*Assistant Examiner*—Henry J. Recla
*Attorney, Agent, or Firm*—D. Schron

[57] ABSTRACT

Underwater breathing apparatus including a diver worn back pack having a hard outer shell and a soft flexible undersurface to conform to the diver's back. Breathing bags positioned between the undersurface and outer shell are connected to the undersurface so as to extend down the diver's back and be coextensive with his lungs. Gas circuit components are mounted on the inside of the shell. The apparatus makes contact with the diver's back, at a small area on the upper portion of his back, and, at the lower portion of the diver's back two extending projections from the shell receive a transverse strap which contacts the diver in the vicinity of the small of his back.

17 Claims, 14 Drawing Figures

BREATHING APPARATUS

This is a continuation of application Ser. No. 832,669 filed June 12, 1969, and now abandoned.

BACKGROUND OF THE INVENTION

1. Field of the Invention

This invention in general relates to breathing apparatus, and particularly to underwater breathing apparatus incorporating flexible breathing bags.

2. Description of the Prior Art

In undersea work, it is absolutely required to conserve, through good design, as much as possible of the diver's total expendible energy so that it may be fully applied toward a specific task. The diver should not have to exert much-needed energy in fighting his equipment and his environment. For example in underwater breathing apparatus incorporating breathing bags, when the diver is in the swimming position the buoyancy of the breathing bags acting at one point in conjunction with the weight of certain components acting at another point tends to produce a restoring moment which the diver must fight. Large inspiratory or expiratory efforts must be avoided, and in general the diving rig must be comfortable to avoid an adverse reaction by the diver.

The components of many diving rigs are mounted on a flat plane of metal or other rigid material and occasionally covered with a shaped cover. The resulting package is esthetically pleasing however the diver's back is not a flat plane and in use at hundreds of feet in the water, esthetics become of little significance to the diver in view of the discomfort and instability experienced. Breathing bags have been incorporated in such structures and have been positioned high on the diver's back at the top of the inside of the package, in conjunction with an exhaust valve which determines the pressure of the breathing gas in the system. This placement of components results in a system which is quite diver position sensitive so that the pressure varies excessively, to the discomfort of the diver.

Another approach has been to contour the component holder to the normal curvature of a man's back. The problem arises however that the normal curvature for one person is an abnormal curvature for another person so that variation in human sizes and build limits the usefulness to other than one person for whom the rig was designed.

It is therefore a primary object of the present invention to provide underwater breathing apparatus that substantially reduces, and in some cases eliminates, the inadequacies of prior art devices.

SUMMARY OF THE INVENTION

Basically, there is provided underwater breathing apparatus which includes a relatively hard inflexible outer protective shell which carries many components for gas flow control. A relatively soft flexible body-conforming under-surface is connected to the shell and is separable therefrom so as to service various components.

Breathing bag means are positioned between the undersurface and the shell and preferably are connected to the undersurface and extend substantially coextensively with the diver's lungs. Gas admission means and breathing tubes for the diver are provided in addition to means for supporting the apparatus on the diver's back.

DESCRIPTION OF THE PREFERRED EMBODIMENT

Figure 1:
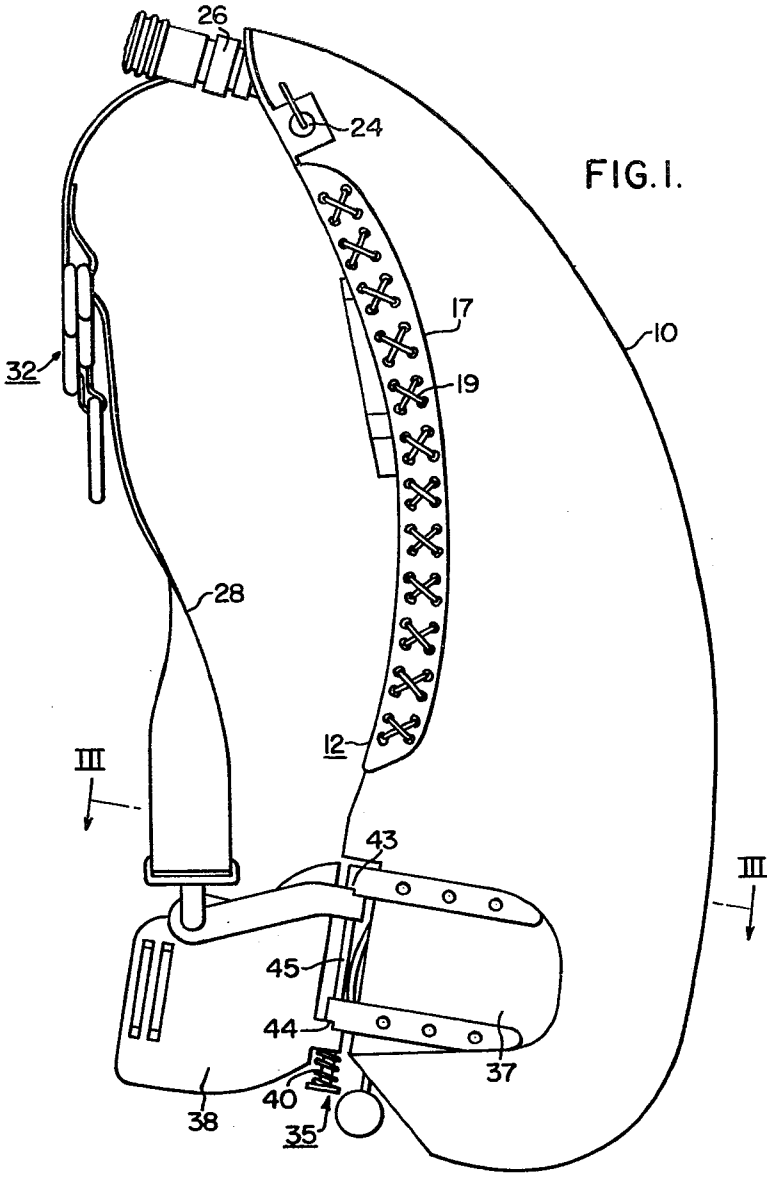
FIGS. 1 and 2 are side and front views respectively of a preferred embodiment of the present invention.
Figure 2:
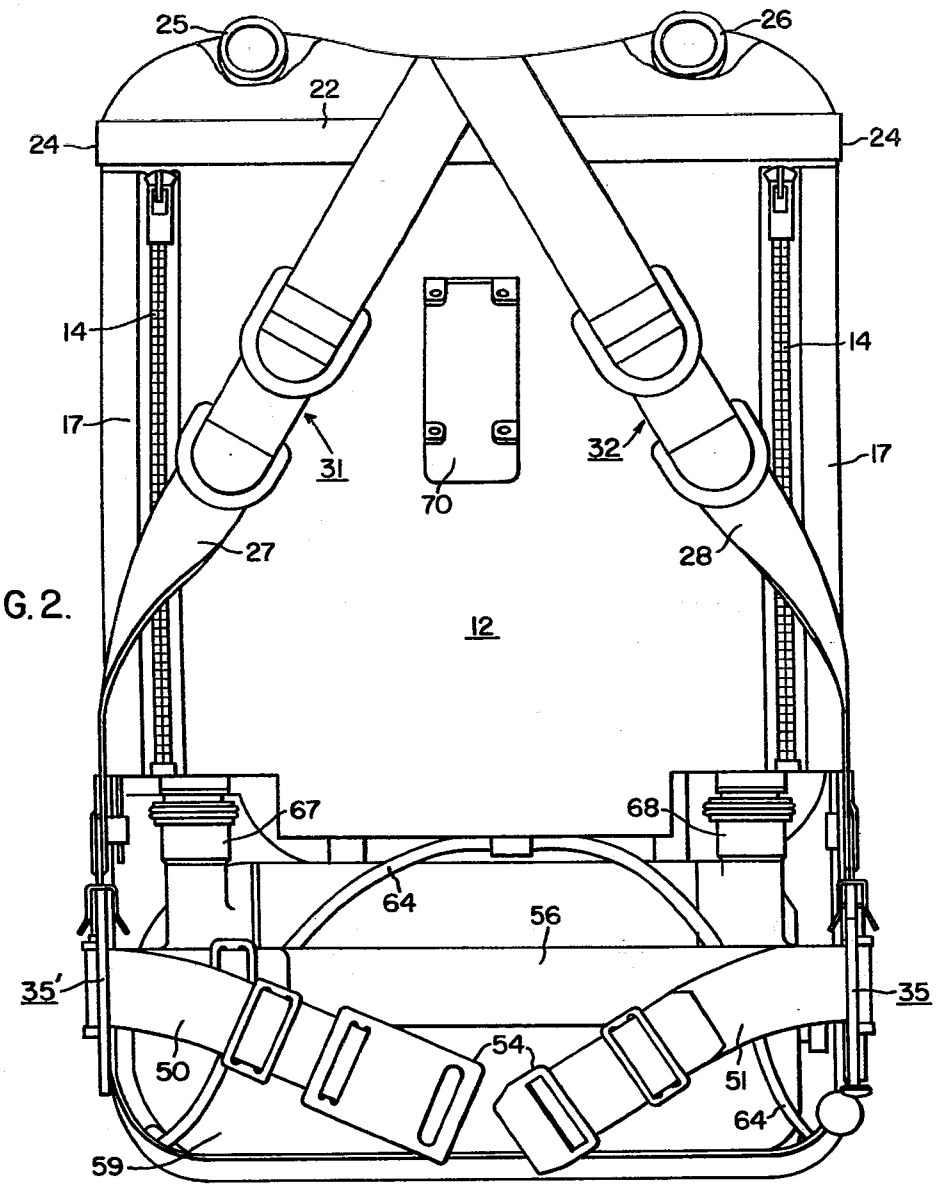

Referring now to FIG. 1 there is illustrated breathing apparatus incorporating a relatively hard, inflexible outer protective shell 10 and, as better viewed in FIG. 2, a relatively soft flexible body conforming undersurface 12 connected to the shell 10. The shell 10 may be fabricated of molded plastic or fiberglass and the undersurface 12 may be a soft material such as nylon, it being understood that such materials are mentioned only by way of example.

For servicing internal components, the undersurface 12 is separably connected to the shell 10 by complementary fastening means such as zippers 14. A portion 17 of the undersurface 12 is attached to the edge of shell 10, the attachment means illustrated in FIG. 1 being lacing 19. The portion 17 carries one half of the zipper with the other half being carried by the edge of undersurface 12.

The upper part of undersurface 12 is attached to a transverse strap 22 the ends of which are connected to the shell at points 24 so that when the zippers 14 are opened, the undersurface 12 may be swung up over the top of the shell 10 for servicing internal components. Connections 25 and 26 are provided for communicating the breathing apparatus with a diver.

Means for supporting the apparatus on the diver include shoulder straps 27 and 28 connected to the upper part of the shell 10 and having respective adjusting means 31 and 32. The lower ends of the shoulder straps 27 and 28 are detachably connected to respective arm assemblies 35 and 35' defining rigid projections on either side of the lower portion of the shell 10. A typical arm assembly such as assembly 35 in FIG. 1 includes a first or stationary member 37 secured to the shell 10 and a second or a movable member 38 which is illustrated in locked position but which may be moved out of locked position for storing, by depressing it against the action of spring 40 to thereby disengage complimentary locking surface 43 and 44 whereby member 38 may be rotated inwardly about rod 45. Strap 50 connected to arm assembly 35', and strap 51 connected to arm assembly 35 fit around the diver's waist and are connectable by means of buckle 54.

Adjustable strap 56 is connected to respective arm assemblies 35 and 35' and forms a load bearing surface, as will be discussed hereinafter. Relative positioning of strap 56 may better be seen in FIG. 3 which is a view along line III—III of FIG. 2.

Figure 3:
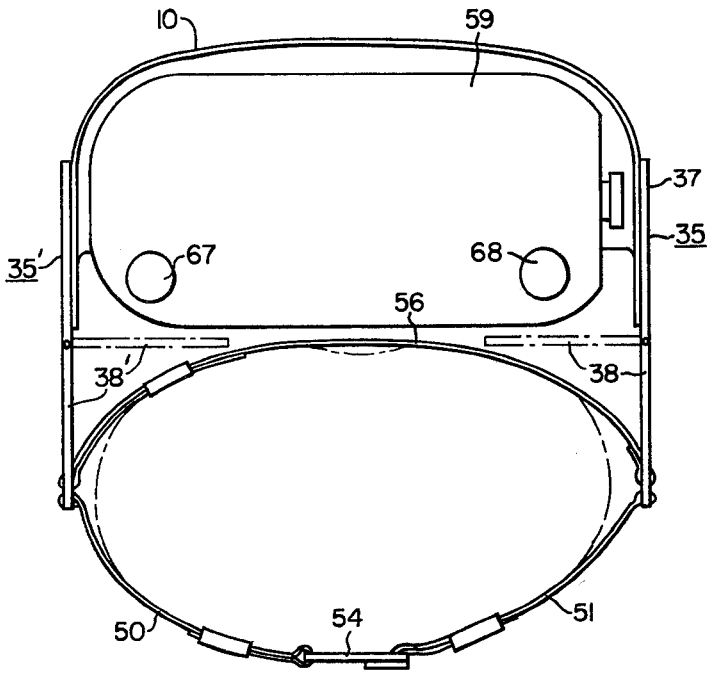
FIG. 3 is a view along lines III—III of FIG. 1.

As seen in FIG. 3, arm assemblies 35 and 35' connected to, and projecting from, the shell 10 provide for strap 56, attachment points disposed at a distance from the shell 10 such that the strap 56 extended between the attachment points serves to prevent equipment such as carbon dioxide absorbent cannister 59 from banging into the diver and additionally serves as a force distributing means for distributing the compressive forces encountered when the apparatus is worn and straps 27, 28, 50 and 51 are properly adjusted.

It has been stated that the second member 38 of arm assembly 35 is movable for storage. In FIG. 3 the movable members 38 and 38' are shown dotted in their storage position.

Referring back to FIG. 2, the illustrated apparatus includes various components for a breathing system and which are connected to the shell 10. One such component is the carbon dioxide absorbent cannister 59 positioned at the lowermost portion of the shell 10 and held in place by means of, for example, an elastic cord 64, the ends of which are secured to the shell 10. The cannister 59 is connected to breathing bags, to be described, by means of couplings 67 and 68 which are readily disconnectable for servicing the cannister. Although the undersurface 12 may be fastened to the shell from the top of the shell to the bottom of the shell it is more convenient to have it extend, as illustrated, only down to the cannister 59 so that servicing may take place without the necessity for unfastening the undersurface 12.

The strap 56 contacts the diver in the vicinity of the small of his back and is a load supporting surface. Another contact area occurs at the upper part of the diver's back. In order that a wide variation of diver shape and sizes be accommodated it is preferable, although not an absolute requirement, that the contact area at the upper part of the back be relatively small and be positioned between the diver's shoulder blades. Contact pad 70 on the outside of the undersurface 12 may be made of soft rubber and defines another load supporting area in, addition to the strap 56. Positioned behind contact pad 70 is a spacing and load supporting means which extends to the shell 10.

In summary, when the apparatus is placed on the diver and straps 50, 51 and shoulder straps 27 and 28 tightened, the shell 10 is drawn close to the diver's back but does not bear against it. The shell 10 is maintained at a spaced distance and accordingly the general contour of the shell 10 will fit most divers.

The forces pulling the apparatus close to the diver are transmitted to, and supported by two contact areas. The size and positioning of these contact areas also insure that the apparatus will fit most divers.

When the straps are tightened a compressive force is transmitted to contact pad 70 by the spacing and load supporting means positioned behind it and extending to the shell 10. A compressive force is also transmitted by arm assemblies 35, 35' and distributed by strap 56 to a contact area in the vicinity of the small of the diver's back.

Figure 4:
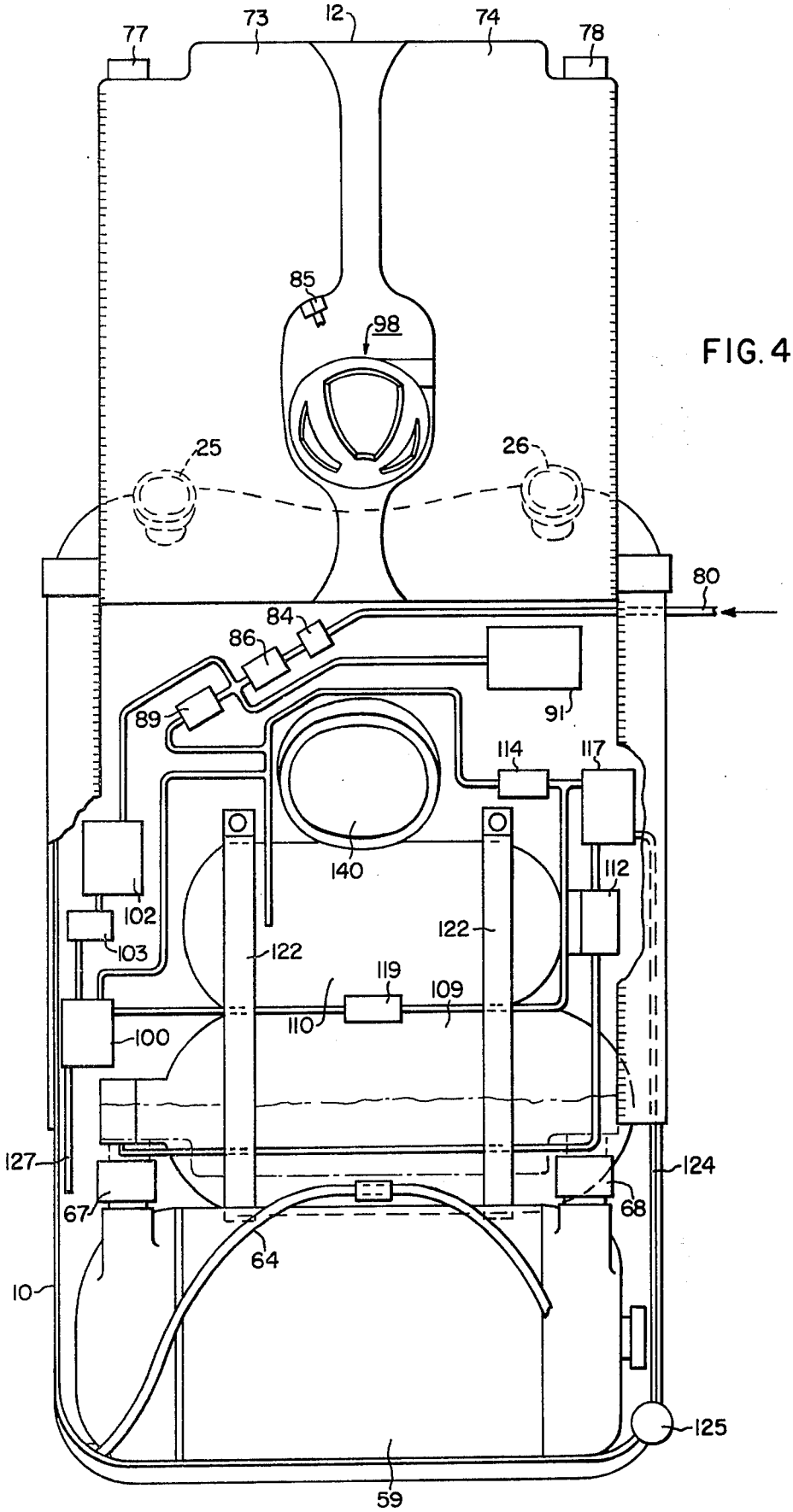
FIG. 4 is a front view, as in FIG. 2, with the undersurface lifted as to view the inside of the apparatus.

Behind the undersurface 12 is a plurality of components utilized in a breathing system. FIG. 4 is a view of the apparatus with the undersurface 12 turned up to provide an internal view. The supporting means including the various straps are not illustrated. The apparatus includes breathing bag means in the form of first, or inhalation breathing bag 73 and second, or exhalation breathing bag 74 connected to, or forming an integral part of the undersurface 12. When in position, the breathing bags 73 and 74 lay very close to the diver's back and substantially extend coextensively with the diver's lungs. The small projections 77 and 78 connect with couplings 67 and 68 of the cannister 59.

Figure 5:
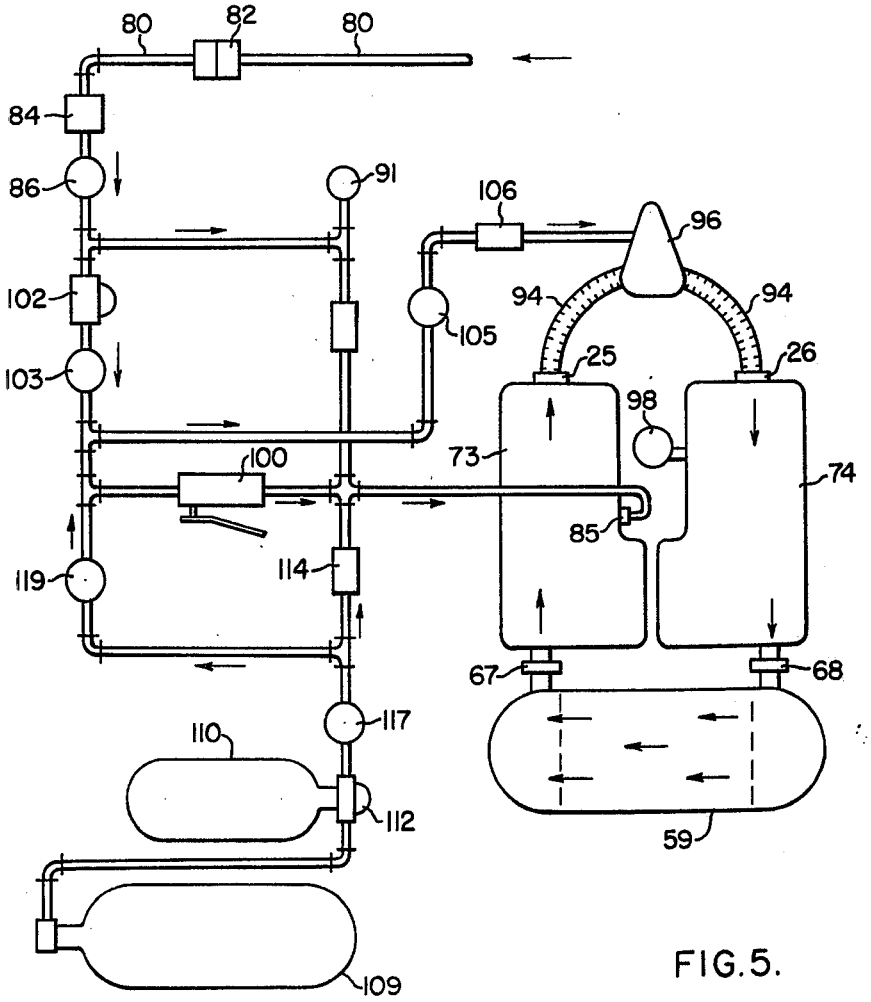
FIG. 5 is a schematic flow diagram of the particular breathing system viewed in FIG. 4.

Disposed in, and carried by the shell 10, are various gas circuit components of a breathing system diagrammatically illustrated in FIG. 5 to which reference is now made.

For deep ocean work the diver is supplied with a breathable gas from a remote supply by means of an umbilical 80 having an in-line quick disconnect 82. The gas is given a final cleansing by means of filter 84, and is supplied to the input 85 of inhalation breathing bag 73 by way of a check valve 86 and gas metering orifice 89. The output pressure of check valve 86 is sensed by the switchover indicator 91 which signals the diver, that gas is being supplied by means of the umbilical 80.

Gas admitted to the inhalation bag is breathed by the diver by means of breathing tube 94 connected to the inhalation bag 73, oral-nasal mask 96, and breathing tube 94 connected to the exhalation bag 74. Upon each breath, gas in the exhalation bag 74 passes through the carbon dioxide absorbent cannister 59 and then into the inhalation breathing bag 73 to be rebreathed. In a semi-closed type system utilizing breathing bags, there is included an exhaust valve which maintains the breathing system pressure breathed by the diver, at a certain value greater than the ambient pressure at the exhaust valve. The exhaust valve structure 98 is connected to the exhalation bag 74 and is preferably physically located between the breathing bags 73 and 74 very close to the diver's back.

If the diver wishes to admit a large quantity of gas to the breathing bags to purge them, he may activate purge valve 100 which allows the gas from the umbilical 80 to enter the inhalation breathing bag 73 by way of regulator 102 and one way check valve 103. If the breathing bags should accidentally become cut and inoperative, there is provided an emergency regulator 105 operable by activation of regulator control 106 whereby the apparatus acts as a conventional open circuit remote supply breathing system.

If the umbilical 80 should accidently become cut there is provided an emergency gas supply in gas bottles 109 and 110 which would, when valve 117 is opened, supply gas through regulator 112 to the inhalation breathing bag 73 by means of gas metering orifice 114. If the umbilical 80 is cut, the pressure at switchover indicator 91 would drop and the diver would be signalled to thereby activate the valve 117. Alternatively, activation of valve 117 may be made automatically by means of pressure responsive control devices. The gas from supplies 109 and 110 may be provided to the inhalation breathing bag 73 in a large quantity by the path including check valve 119 and purge valve 100. For shallow water work, the gas supply bottles 109 and 110 may serve as the primary gas supply, however, as noted for deep ocean work, they would serve as an emergency gas supply affording the diver several breaths to get back to a protective atmosphere of an underwater chamber or habitat.

The gas supply bottles 109 and 110 could also serve as the primary gas supply for deep ocean work in a closed breathing system, in which case oxygen would be supplied to a helium breathing gas only as needed in accordance with the output of a partial pressure of oxygen sensor (not shown).

Except for the gas supply bottles 109 and 110 and cannister 59, the various gas circuit components of FIG. 5 are illustrated in block diagram form inside the shell 10 of FIG. 4. The gas supply bottles 109 and 110 are held in place by means of metallic straps 122 fastened to the shell 10. If the valve 117 is diver activated there may be provided a rod 124 which extends to the lower part of the shell and which includes a knob 125 on the end thereof for diver activation. Another rod 127 extends down the other side of the shell and may be pushed by the diver for activation of the purge valve 100.

When the breathing bags are inflated, and inflation may be in the order of 8 liters of gas, there is a positive buoyant force acting at a center of buoyancy, positioned between the breathing bags. The various gas circuit components are disposed in the vicinity of the breathing bags and the weight of these components are collectively centered at a point very close to the center of the buoyancy to thereby eliminate turning moments when the diver is in certain swimming positions.

Figure 6:
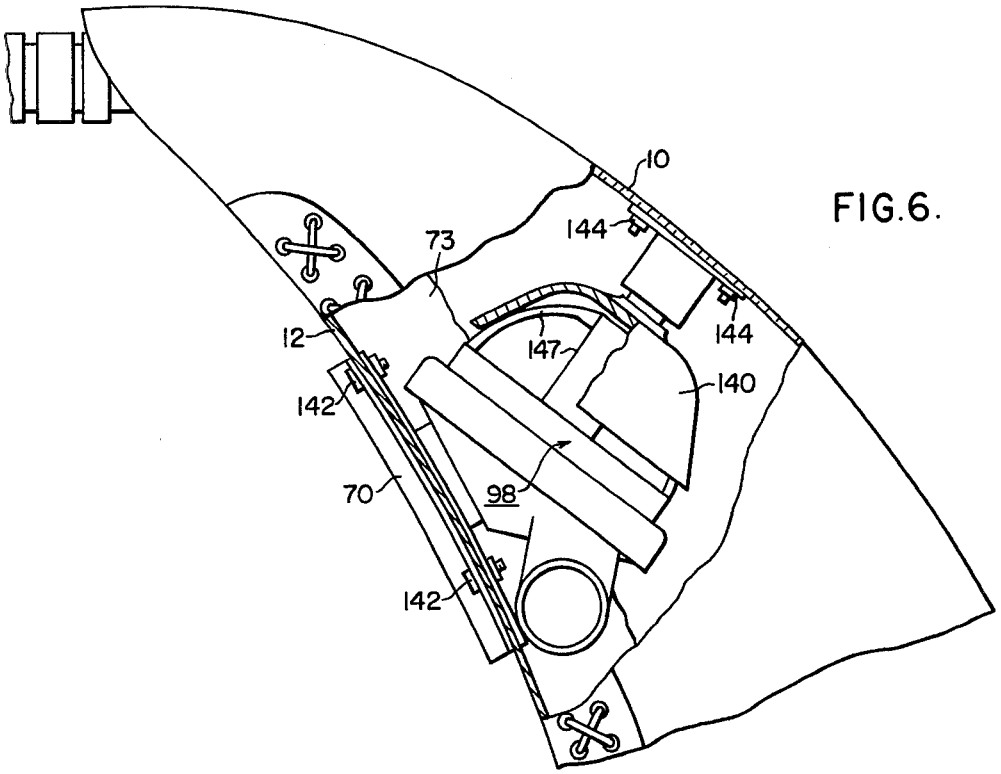
FIG. 6 is a partial view of the apparatus as in FIG. 1, with a portion of the apparatus broken away and illustrating an exhaust valve and receiver in mating position.

When the undersurface 12 is placed into position, the valve 98 mates with a receiver member 140 fastened to the shell 10 in such a manner that the receiver 140 and valve 98 form a spacing and load supporting means extending from the shell 10 to the undersurface 12. FIG. 6 is a side view of a portion of the apparatus with parts broken away illustrating the mating relationship between the valve 98 and the receiver member 140. The valve 98 is positioned on the inside of undersurface 12 between the breathing bags of which inhalation bag 73 is shown. The contact pad 70 is positioned on the outside of undersurface 12 with the valve 98 and contact pad 70 being joined by means of fasteners 142, with the undersurface 12 being sandwiched between them. The valve receiver member 140 is cup-shaped and connected to the shell 10 by means of fasteners 144. The upper portion of valve 98 constitutes a valve cover 147 which may be defined as having a hemispherical surface portion so as to allow for limited rotatable movement in the receiver 140.

This movable connection allows the contact pad 70 to lie flat in position for the vast majority of different diver back contours and insures that the contact pad 70 remains in proper position even though the shell 10 may be moved somewhat during wearing. Although a conventional spring loaded exhaust valve may be utilized, it is preferable that the breathing system incorporate a valve which varies its setting in accordance with positional orientation, as described and claimed in copending application Ser. No. 832,671 filed June 12, 1969 and assigned to the same assignee as the present invention. With incorporation of such valve it is desired that the valve axis remain pointed at a reference point positioned within the diver. The rotatable engagement of the valve 98 with the receiver 140 insures this positioning while still maintaining a force transmitting arrangement from the shell 10 to the diver's back at a first load supporting area defined by the contact pad 70.

Figure 7:
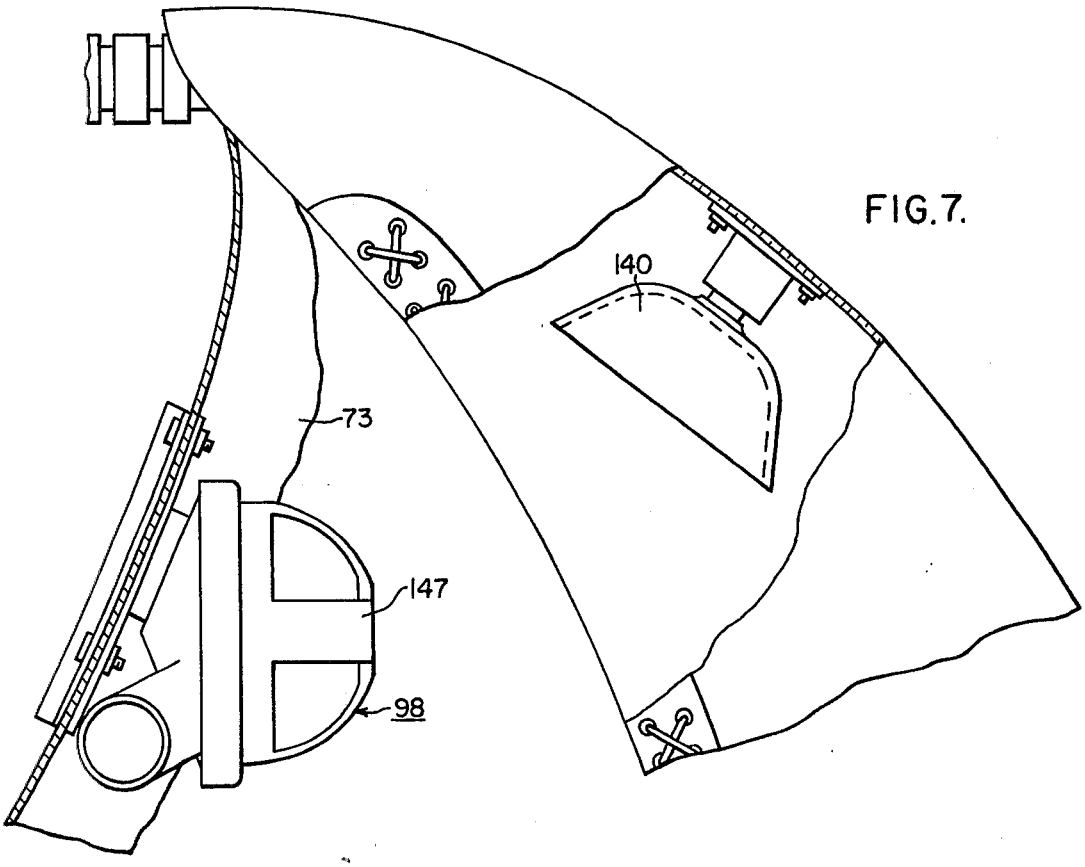
FIG. 7 is a view as in FIG. 6 with the valve and receiver in the separated position.

In FIG. 7, the undersurface 12 has been unconnected and pulled away somewhat from shell 10 providing a view of the valve 98 and receiver member 140 in an unmated relationship. Although the receiver 140 is shown as being cup-shaped, it is obvious that other structures may be provided to perform the same receiver function.

Figure 8:
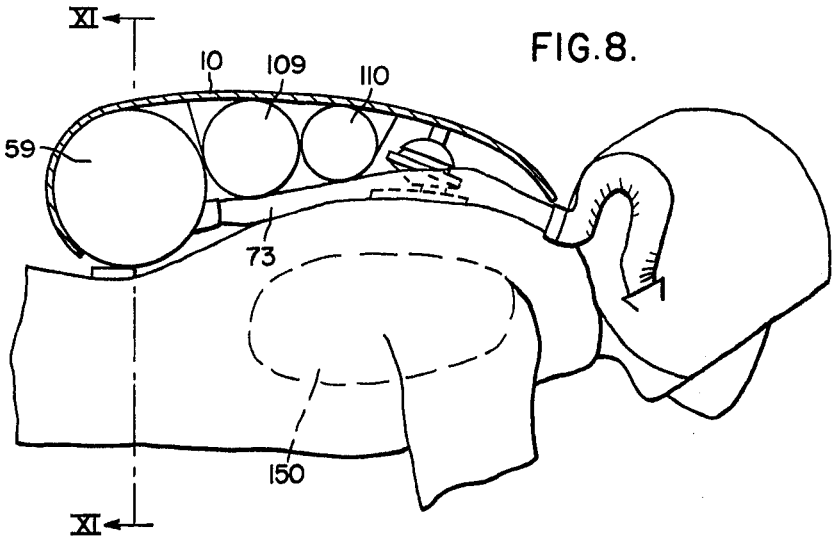
FIG. 8 is a side view of a diver wearing the apparatus, shown partially in section.

FIG. 8 is a view of a helmeted diver in the prone swimming position and illustrates, with portions broken away, the placement of the apparatus on the diver's back. The breathing bag means, of which the inhalation breathing bag 73 is shown, extends down the diver's back and is coextensive with the diver's lungs 150 and the vast majority of system components are carried by the shell 10. The shell 10 is supported away from the diver's back and the compressive load thereof when the straps (FIG. 2) are tightened is transmitted to the diver at two contact areas, one being defined by the contact pad 70 and the other being defined by the strap 56. This supporting arrangement allows free and unhindered movement of the breathing bags.

Figure 9:
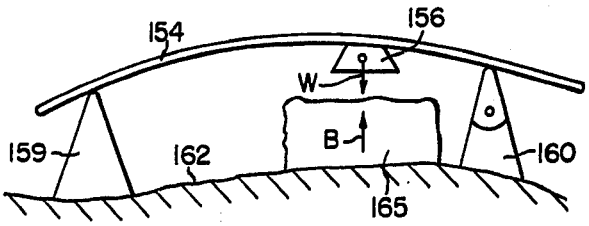
FIG. 9 illustrates an equivalent force diagram for the situation of FIG. 8.

FIG. 9 is a load or force diagram representative of the apparatus as pictured in FIG. 8. Rigid bridging member 154, carrying a load 156, is supported at one end by support member 159 and at the other end by pivotal support member 160, which allows placement on various contour surfaces such as surface 162. Bridging member 154 is maintained at a spaced position with respect to surface 162 and flexible bellows 165 is free to expand and contract within the area enclosed by bridging member 154 and surface 162. An analogy between the diagram of FIG. 9 and the apparatus of the present invention may be made as follows:

| | |
|---|---|
| bridging member 154 | shell 10 |
| support member 159 | arm assemblies 35, 35' and strap 56 |
| support member 160 | receiver member 140 and valve 98 |
| surface 162 | undersurface 12 and diver's back |
| load 156 | gas circuit components |
| flexible bellows 165 | breathing bags 73 and 74. |

The collective weight of the various gas circuit components is represented by arrow W. The buoyancy of the breathing bags is represented by the arrow B. By distributing the gas circuit components in the vicinity of the breathing bags W can be made very nearly colinear with B so as to prevent undesired turning couples which would tend to rotate the diver to a vertical position. Load 156 does not necessarily represent or include gas supply bottles 109 and 110 or cannister 59 since these components are approximately neutrally buoyant in the water.

Figure 10:
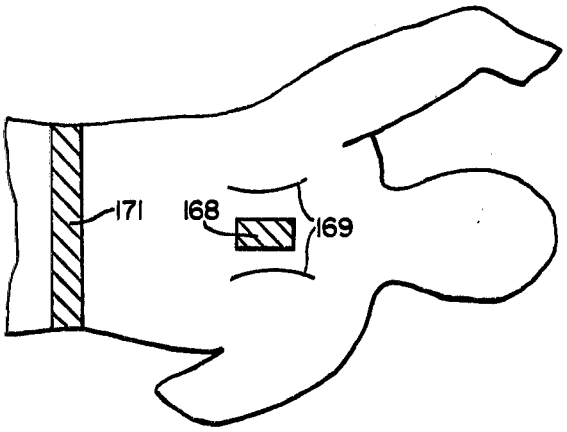
FIG. 10 is a view of the diver's back showing the apparatus contact areas.

The apparatus in the embodiment illustrated provides a first load supporting area which contacts the diver on the upper portion of his back. Preferably, and as illustrated in FIG. 10, this contact area 168 is positioned between the diver's shoulder blades 169. A second load supporting area contacts the lower part of the diver's back such as the contact area 171 in the vicinity of the small of the diver's back. The contact area 171 is due to the strap 56 which is flexible and can conform to innumerable body shapes. The contact area 168 is relatively small so that the entire apparatus is supported by the diver at two contact areas substantially common to all diver forms and shapes.

Figure 11:
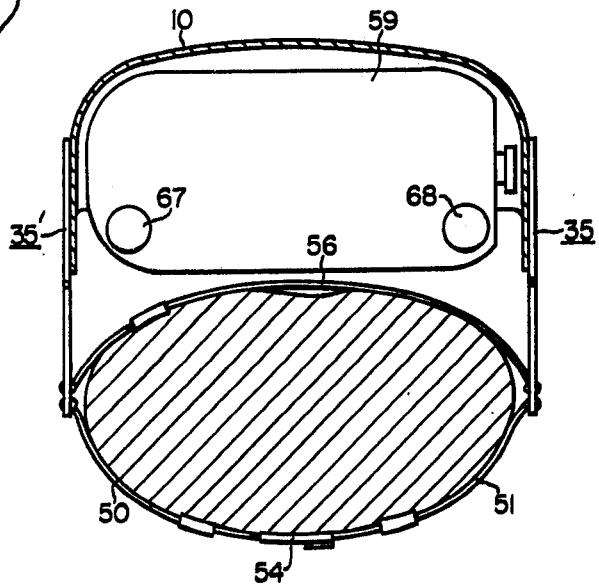
FIG. 11 is a view along line XI—XI of FIG. 8.

FIG. 11 is a view along line XI—XI of FIG. 8 and illustrates the arm assemblies 35 and 35' in extended position which in conjunction with strap 56 prevents compressive forces from acting against the diver's back in a concentrated area since these compressive forces are transmitted to a distributed contact area (area 171 in FIG. 10).

Figure 12:
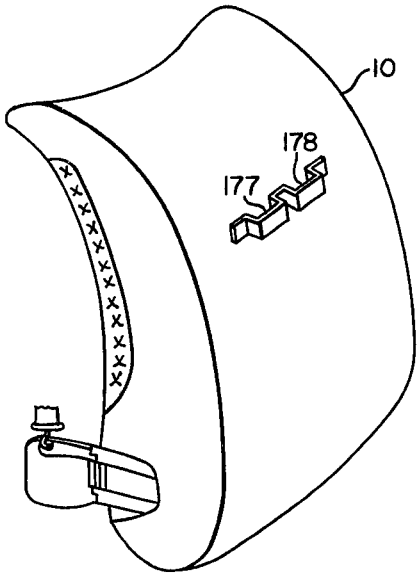
FIG. 12 illustrates the apparatus with a hanger attachment.
Figure 14:
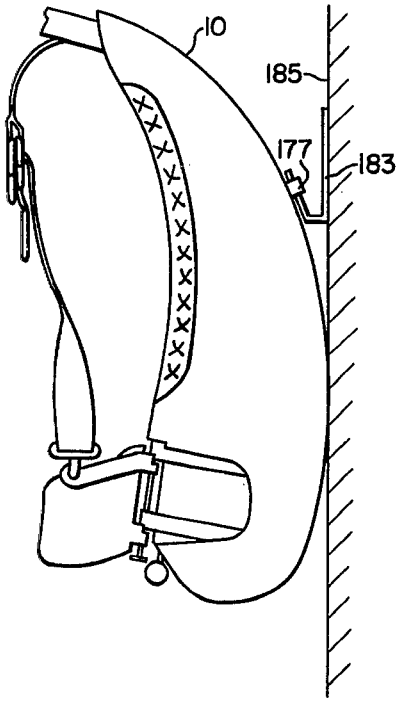
FIG. 14 illustrates the apparatus of FIG. 12 in a stowed condition.
Figure 13:
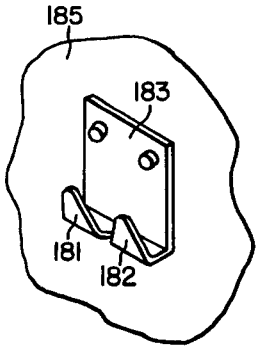
FIG. 13 illustrates a receiving hanger.

In order to aid the diver in donning and removing the equipment, there may be provided a hanger arrangement such as illustrated in FIGS. 12 and 13. Secured to the back of shell 10 are two hanger brackets 177 and 178 either one of which may also serve as a convenient carrying handle for the apparatus. The brackets 177 and 178 fit over projections 181 and 182 of hanger 183 which is secured at a convenient height to structural member 185. The equipment is placed on the hanger 183 as illustrated in FIG. 14, the positioning of hanger 183 being such that the diver may conveniently back into and don the equipment after which it may be removed from the hanger 183. Similarly, after use, the diver may back up to the hanger 183, engage the projections 181 and 182 with brackets 177 and 178 and unfasten the various straps whereby the undersurface may be unfastened for equipment servicing.

The present invention has been described with respect to underwater breathing apparatus although it is obvious that various other arrangements may be provided and that the principals may be applied to back pack apparatus, containing breathing or other equipment.

I claim:

1. Underwater breathing apparatus, comprising:

A. a relatively hard inflexible outer protective shell;

B. a relatively soft flexible body-conforming undersurface for placement on a diver's back and connected to said shell;

C. breathing bag means positioned between said undersurface and said shell;

D. means for admitting a breathable gas to said breathing bag means;

E. means for communicating said breathing bag means with the diver;

F. said apparatus being constructed and arranged that said breathing bag means is freely movable in the area between said undersurface and said shell when communicative with the diver and when supplied with said breathing gas; and G. support means for supporting said apparatus on the diver.

2. Apparatus according to claim 1, which includes

A. complementary fastening means connected to the edge portion of the shell and the edge portion of the undersurface for easily separating the shell and undersurface for gaining access to the interior of the shell.

3. Apparatus according to claim 1, wherein:

A. the breathing bag means extend substantially coextensively with the diver's lungs.

4. Apparatus according to claim 3, wherein:

A. the breathing bag means are connected to the undersurface and are movable therewith.

5. Apparatus according to claim 3, wherein:

A. the breathing bag means include an inhalation breathing bag and an exhalation breathing bag; and which additionally includes B. an exhaust valve connected to one of said breathing bags and positioned between them.

6. Apparatus according to claim 1, which includes

A. a plurality of gas circuit components

B. said plurality of gas circuit components being carried by the shell, interiorly thereof.

7. Apparatus according to claim 1, which includes

A. a force transmitting rotatable coupling extending between the shell and the undersurface;

B. said coupling including a first member and a second member;

C. said first member having a hemispherical surface portion;

D. said second member being a receiver member for said hemispherical surface portion for allowing limited rotatable movement between said first and second members.

8. Apparatus according to claim 7, wherein:

A. the second member is attached to the shell, and

B. the first member is an exhaust valve structure connected to the breathing bag means.

9. Apparatus according to claim 8, wherein:

A. the breathing bag means is formed as part of the undersurface; and wherein

B. the exhaust valve structure seats in the receiver member when the undersurface is connected to the shell, and C. the exhaust valve means unseats from the receiver member when the undersurface is unconnected from the shell.

10. Apparatus according to claim 7, which includes

A. a soft contact pad positioned on the outside of the undersurface;

B. the first member being connected to said contact pad with the undersurface being sandwiched therebetween.

11. Apparatus according to claim 10, wherein:

A. the contact pad is positioned to contact the upper portion of the diver's back in the vicinity of the shoulder blades.

12. Apparatus according to claim 1, wherein the support means includes

A. first and second arm assemblies connected to the lower part of the shell and extendable therefrom to respective first and second positions in front of the shell, and B. a flexible force distributing means for connection to said arm assemblies at said first and second positions for contact with the diver's back in the vicinity of the small of the back and being out of contact with said shell when worn by the diver.

13. Apparatus according to claim 12, wherein:

A. the flexible force distributing means is a strap connected to the arm assemblies at the first and second positions.

14. Apparatus according to claim 12, wherein:

A. each arm assembly includes first and second arm assembly members;

B. said first arm assembly member being connected to the shell;

C. said second arm assembly member being connected to said first arm assembly member and movable relative thereto;

D. locking means for interlocking said first and second arm assembly members to prevent such relative movement.

15. Apparatus according to claim 1 which additionally includes:

A. bracket means attached to the outside of the shell for hanging up the apparatus on complementary hook means.

16. Apparatus according to claim 15, wherein:

A. the bracket means are in the form of at least one carrying handle.

17. A back pack comprising:

A. a relatively hard inflexible outer protective shell;

B. a relatively soft flexible body conforming undersurface for placement on the user's back and connected to said shell;

C. first load supporting means connected to said shell and extending to said undersurface and forming a first load supporting area on said undersurface;

D. second load supporting means connected to said shell and forming a second load supporting surface;

E. said first load supporting area being for contact with the upper part of the user's back and the second load supporting area being for contact with the lower part of the user's back in the vicinity of the small of the back; and F. breathing apparatus components carried interiorly of the shell.

* * * * *